US006311537B1

(12) United States Patent
Vigil

(10) Patent No.: US 6,311,537 B1
(45) Date of Patent: Nov. 6, 2001

(54) BLADE TIP FOR A RESCUE TOOL

(76) Inventor: Orlando C. Vigil, 7096 Snyder Ridge Rd., Mariposa, CA (US) 95338

( * ) Notice: Subject to any disclaimer, the term of this patent is extended or adjusted under 35 U.S.C. 154(b) by 0 days.

(21) Appl. No.: 09/430,777

(22) Filed: Oct. 29, 1999

Related U.S. Application Data

(60) Provisional application No. 60/106,432, filed on Oct. 30, 1998.

(51) Int. Cl.[7] ..... B21D 31/04

(52) U.S. Cl. ..... 72/392; 72/705; 254/133 R

(58) Field of Search ..... 30/168; 72/392, 72/705; 254/93 R, 123, 131, 133 R

(56) References Cited

U.S. PATENT DOCUMENTS

| | | | | |
|---|---|---|---|---|
| Re. 33,002 | | 8/1989 | Brick | 30/134 |
| 2,379,387 | * | 6/1945 | Tessier | 254/131 |
| 3,219,316 | * | 11/1965 | Fried | 254/131 |
| 4,273,311 | | 6/1981 | Rio | 254/93 |
| 4,392,263 | * | 7/1983 | Amoroso | 72/464 |
| 4,522,054 | | 6/1985 | Wilson et al. | 72/392 |
| 4,531,289 | | 7/1985 | Brick | 30/134 |
| 4,842,249 | * | 6/1989 | Weigand | 254/93 R |
| 4,896,862 | | 1/1990 | Ganley | 254/1 |
| 4,973,028 | | 11/1990 | Linster | 254/93 |
| 5,297,780 | | 3/1994 | Hicherson | 254/124 |
| 5,622,353 | | 4/1997 | Painter et al. | 254/93 |

OTHER PUBLICATIONS

Rescue Systems, Holmatro rescue tools (industrial & rescue equipment), pp. 15–16.

Hurst Jaws of Life, Diamond Jaw Tips, L.N. Curtis & Sons, emergency equipment, Hale Idex, Idex Corporation, Jan. 15, 1998.

TNT Rescue Systems, Inc., spreaders, 2.5 Bantam Power Units, 5.5 Bantam Twin Power Units, Cutters, Combination tools, Rams, Accessories.

Curtiss–Wright Power Hawk Rescue Systems, February 1999, Curtiss–Wright Flight Systems, Inc.

* cited by examiner

*Primary Examiner*—Lowell A. Larson
(74) *Attorney, Agent, or Firm*—Sierra Patent Group Ltd.

(57) ABSTRACT

A blade tip for a rescue spreading tool for spreading apart high strength materials to extricate one or more individuals from a damaged vehicle. The rescue spreading tool has a main body and a pair of arms operatively coupled to the main body and configured to move along an axis. A forked blade tip is releasably coupled to each of the arms and has a wide footprint for gripping the high strength materials. Additionally, each of the forked blade tips is configured to interface with an anchor point, such as a door pin from a damaged vehicle.

2 Claims, 6 Drawing Sheets

BLADE TIP FOR A RESCUE TOOL

This application claims priority to U.S. Provisional Application No. 60/106,432, filed on Oct. 30, 1998 titled "Spreader Type Rescue Tool."

BACKGROUND OF THE INVENTION

FIELD OF THE INVENTION

The present invention relates to a blade tip for a rescue tool. More particularly, the present invention relates to a forked blade tip which is coupled to a spreader-type rescue tool.

A variety of rescue tools are available for extricating accident victims from vehicles whose exits have been rendered inoperable. These rescue tools apply spreading and closing forces for opening or ripping apart inoperable doors or cutting through relatively thick metal layers. Generally, these spreading tools have a pair of arms pivotally supported at inner ends and some means for moving the outer ends of the arms toward and away from each other. Most spreader type rescue tools include a pair of metal blade tips mounted on the arms, wherein the blade tips are sufficiently strong to spread apart vehicle structural components. The opening and closing of the arms enables the tools to pull apart metal. For example, U.S. Pat. No. 4,896,862 to Ganley discloses a rescue tool having a pair of arms which are opened and closed by rotating a threaded member.

Often times, the rescue tool is provided with a power means to facilitate operation of the rescue tool. For example, U.S. Pat. No. 5,105,543 discloses a power operated portable cutting tool for rescue work, comprising a cutting head that has first and second blade members, each blade member having a cutting edge portion adjacent one end and a shank portion adjacent the other end. U.S. Pat. No. 4,531,289 to Brick discloses a hydraulic rescue tool comprising a pair of pivotally mounted arms connected to each other within a common yoke, where the arms are forced together or apart by a hydraulically operated piston.

Additionally, spreader rescue tools have been disclosed. Spreader tools generally include a pair of spreader arms, a fluid or hydraulic pressure cylinder, and a support structure or housing. The spreader arms are pivotally attached to the housing in a manner that allows them to rotate about pivot points in response to the extension of the fluid cylinder piston rod. For example, U.S. Pat. No. 4,273,311 to Rio discloses a portable hydraulically operated rescue tool with a pair of force arms.

Unfortunately, rescue tools generally have blade tips that are structured as straight-edge blade members. The straight-edge blade is disadvantageous in that it does not allow the user to exert an equal amount of pressure around the circumference of a vehicle hinge or door pin for releasing the vehicle's door. Additionally, the blade structure of the current blade tip design cannot securely grip a metal screw of a tapered bolt.

While the existing rescue tools mentioned above maybe suitable for some general purposes, they are not as suitable for the purposes of the present invention as disclosed hereafter.

An object of the present invention to provide a blade tip capable of spreading apart high strength materials.

It is another object of the present invention to provide a rescue tool having a forked blade tip to allow the user to exert uniform pressure around the door pin or latch pin of a wrecked vehicle's door.

It is a further object of the invention to provided a rescue tool with a removable blade tip that allows the user to adapt the rescue tool for use with different situations.

Further objects and advantages of the invention will be brought out in the following portions of the specifications, wherein the detailed description is for the purpose of fully disclosing the preferred embodiment of the invention without placing limitations thereon.

SUMMARY OF THE INVENTION

Generally, the present invention is a blade tip for spreading apart high strength materials. More particularly, the present invention is a forked blade tip which is releasably coupled to a rescue tool for extricating one or more individuals from a damaged vehicle. The rescue tool has a main body with a pair of arms movable along an axis and operatively coupled to the main body. The forked blade tip of the present invention is releasably coupled to each of the arms and each of the forked blade tips is configured to interface with an anchor point from the damaged vehicle. In its preferred embodiment, the blade tip has a front face configured to be inserted into a small crevice to grip a high strength material with a plurality of longitudinal teeth. Additionally, the blade tip has a wide footprint to interface with the anchor point such as a door pin of the damaged vehicle.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Persons of ordinary skill in the art will realize that the following descriptions of the present inventions is illustrative only and not in any way limiting. Other embodiments of the invention will readily suggest themselves to such skilled persons having the benefit of this disclosure. For example, the illustrative embodiments of the present invention are disclosed as being operatively coupled to a spreader type hydraulic device, but other technologies such as pneumatic or mechanical spreading technologies could be employed.

Figure 1:
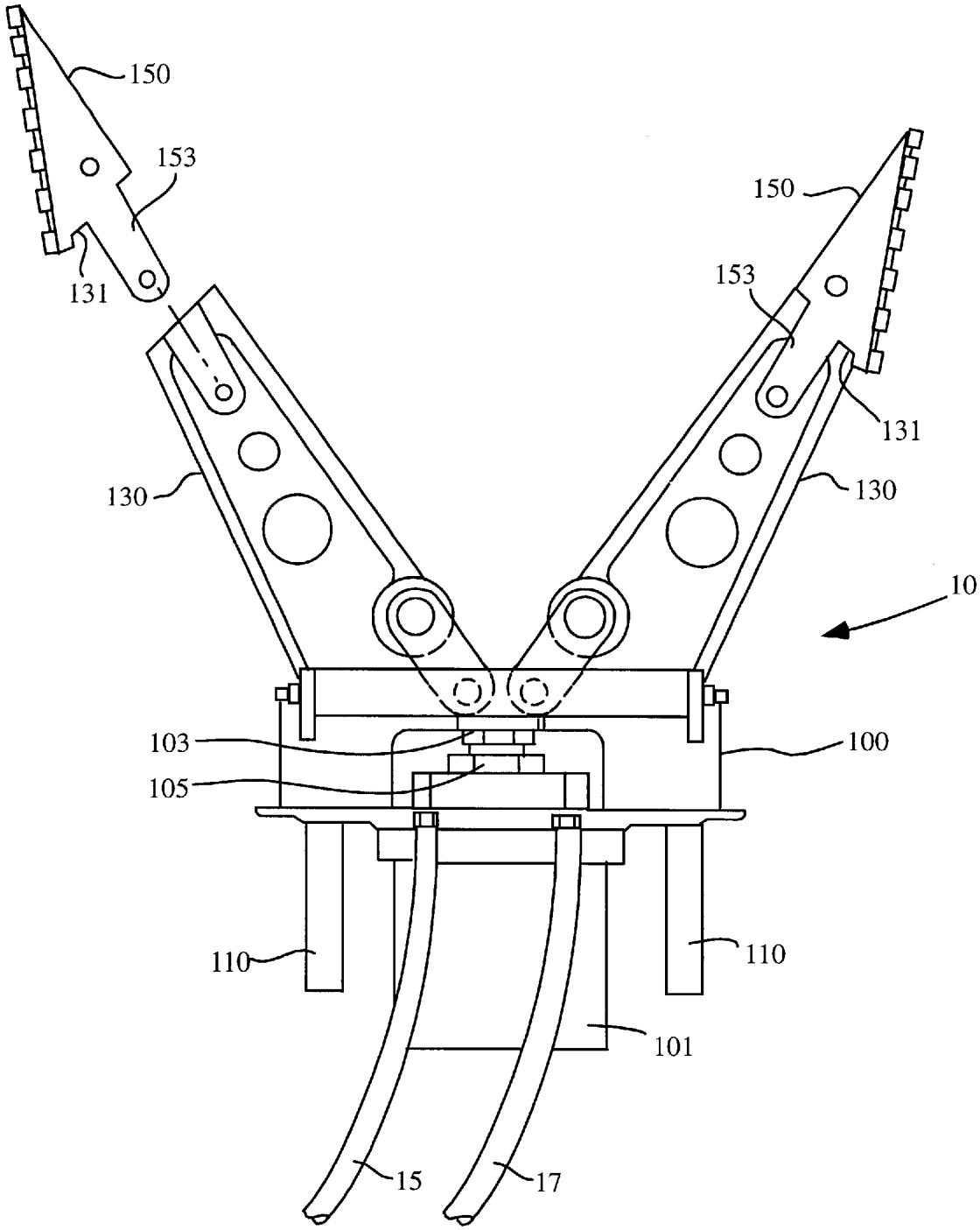
FIG. 1 is an exploded front side view of the rescue tool in accordance with the present invention.

FIG. 1 shows a spreader type rescue tool 10 in accordance with the present invention. The rescue tool 10, sometimes referred to as the "jaws of life", may be used to spread apart a door, metal, or other high tensile material along an anchor point, hinge point or small crevice. Generally, the rescue tool 10 is powered by a hydraulic fluid supplied from an external pump under high pressure. The hydraulic fluid is supplied to the rescue tool 10 through a flexible hydraulic supply line 15. The rescue tool 10 further includes a flexible hydraulic return line 17.

The rescue tool 10 is known in the prior art and comprises a main body 100 made of a high-strength metal, such as steel, hard iron, an aluminum alloy or the like. The rescue tool 10 has a cylindrical fluid chamber 101 having a fluid-actuated piston that moves back and forth within the fluid chamber 101. The main body 100 has a piston rod 103 that is connected to the fluid-actuated piston. The fluid-actuated piston causes the piston rod 103 to move back and forth along a longitudinal axis of the rescue tool 10. The rescue body 10 has a control valve 105 for regulating the flow of the hydraulic fluid to the piston within the fluid chamber 101.

The main body has a pair of handles 110 to facilitate the user in handling the rescue tool 10 under high pressure when the rescue tool 10 is in use.

A pair of arms 130 are pivotally connected to the main body 100, wherein the arms 130 are capable of moving apart to an open position, as shown in FIG. 1, or joining together to a closed position. The back and forth moving of the arms 130 is caused by extending or retracting the piston rod 103 by selectively introducing or removing the hydraulic fluid from the fluid chamber 101.

As with other existing rescue tools, the force exerted by the arms 130 is proportional to the design and capacity of the hydraulic pump connected to the rescue tool 10, and to the size and capacity of the fluid chamber 101. Accordingly, the rescue tool 10 can be constructed to provide any amount of force as required to perform the intended task.

The arms 130 have a substantially triangular shape and are constructed from a high-strength metal, such as a hard iron, steel, an aluminum alloy or the like. Each arm 130 has a tapered flange 131 on its end portion to securely fit a removable blade tip 150. The blade tip 150 has a pair of fastening extensions 153 that extend downwardly therefrom. The fastening extensions 153 slide onto the two sides of the arm 130. The fastening extensions 153 are provided with circular bores 155 that are sized to receive a screw or bolt. The blade tip 150 is firmly placed atop the tapered flange 131 by lining the circular bores 155 with a corresponding bore on the arm 130. Next, the blade tip 150 is secured thereon by extending a bolt through the circular bores 155 and through the corresponding bore in the arm 130. Because of the mechanism for removably fastening the blade tip 150 onto the arm 130, the rescue tool 10 can be selectively fitted with blade tips 150 of different sizes.

Figure 2:
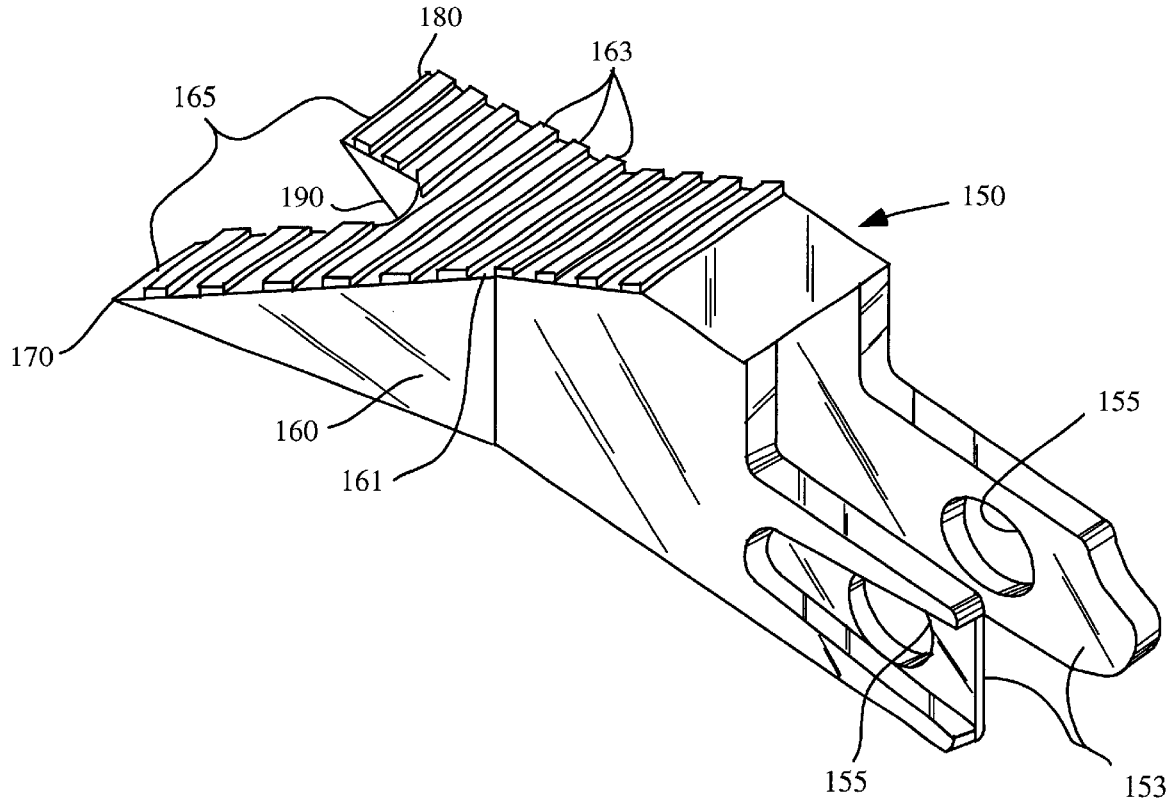
FIG. 2 is a perspective view of a forked blade member.

FIG. 2 is a perspective view of a forked blade tip according to the present invention. As shown in FIG. 2, the front portion 160 of the forked blade tip 150 has a triangular construction provided with a plurality of squarely shaped longitudinal teeth 163 on the front surface 161. The squarely shaped teeth 163 ensure that during use the blade tip 150 does not slip while spreading apart a sturdy piece of high tensile material such as steel. The outer surface 161 tapers downwardly to a leading edge 165 that is configured to be inserted into a small crevice to spread the high tensile material.

The front portion 160 of the blade tip 150 is shaped as a two-pronged fork, having a first prong 170 and a second prong 180 defining a cavity 190. The first prong 170 and the second prong 180 taper outwardly and define a semicircle having a radius of curvature which is adapted to receive an anchor point such as a door pin (not shown) which holds a door to a vehicle closed.

In operation, a pair of blade tips 150 are mounted on the ends of the arms of a rescue spreading tool. The rescue spreading tools include hydraulic spreading tools manufactured by such companies as Hurst, Holmatro, and Amkus. The leading edge 165 of the pair of blade tips 150 is then inserted into a crevice of a high strength material. By way of example and not of limitation, the high strength material may include steel, hard iron, or other alloys which are structural members of an automobile or other vehicle or frame. During collisions these high strength materials may experience high impact loads that generate pockets or crevices. For example, in a high velocity automobile accident, the automobile steel doors and frame will buckle under the stresses from the crash. In such an accident, the car door and car frame may be compressed and not allow access to an injured individual. In order to perform the rescue, the spreading tool is activated and the blade tip is placed in the crevice defined by the door and frame. The arms 130 of the rescue tool are engaged and move apart along an axis, thereby spreading the edge of the car door from the frame. The spreading tool may then be re-engaged to move the arms closer, thereby allowing the blade tip 150 to wedge itself further into the widened crevice. Again, the blade tip 150 grips the high strength material and spreads the high strength material to provide access to an anchor point such as a door pin. The forked blade tip 150 enables the blade tip to receive the anchor point or door pin. The spreading tool applies a lateral force to the anchor point and spreads apart the high strength material about the anchor point, thereby permitting extraction of an individual from a major car accident.

Figure 3A:
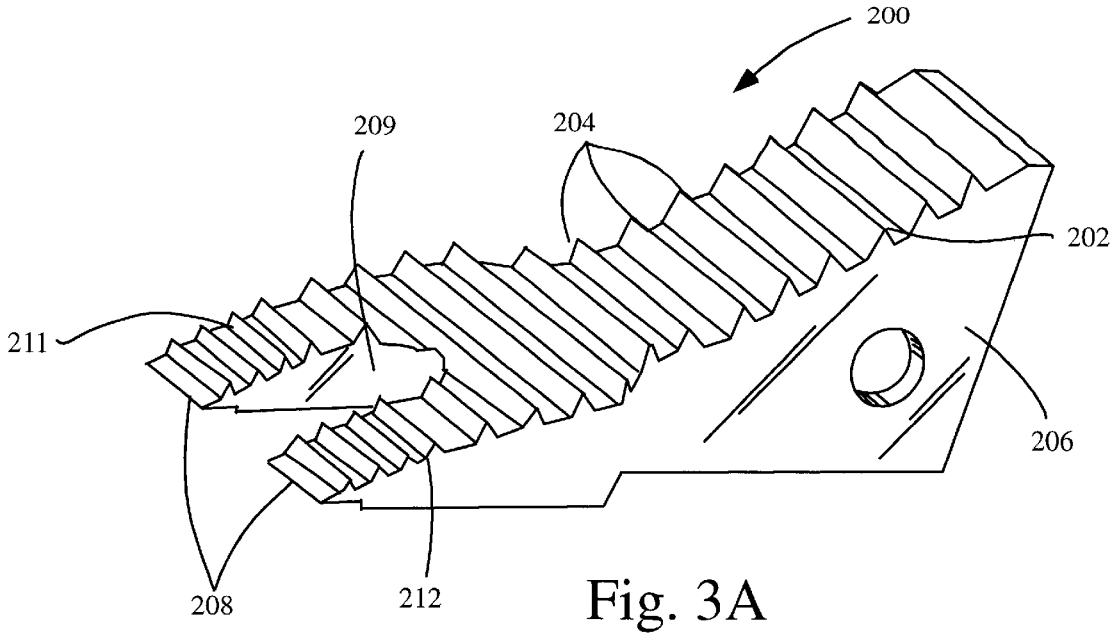
FIG. 3*a* is an isometric view of an alternative forked blade tip.

FIG. 3*a* is an isometric view of a forked blade tip 200. The blade tip 200 has a front face 202 with a plurality of triangular shaped teeth 204 for gripping the high strength metal. The forked blade tip 200 has a receiving end 206 adapted to receive a Hurst hydraulic rescue device (not shown). The leading edge 208 is configured to be inserted into a crevice. The channel 209 defined by a first fork 211 and a second fork 212 is adapted to receive an anchor point.

Figure 3B:
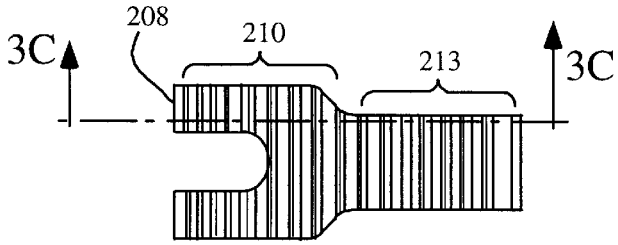
FIG. 3*b* is a top view of the forked blade tip of FIG. 3*a*.

FIG. 3*b* is a top view of FIG. 3*a* and shows the wide footprint 210 of forked blade tip 200. The wide footprint 210 is proximate the leading edge 208 and provides increased surface are for interfacing with the high strength material. The narrow edge 213 is adapted to receive a pair of arms extending from the spreader.

Figure 3C:
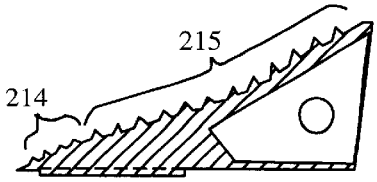
FIG. 3*c* is a cross-sectional view of the forked blade tip of FIG. 3*b* at section 3*c*.

FIG. 3*c* is a cross-sectional view of forked blade tip of FIG. 3*b*. FIG. 3*c* shows in greater detail the shape and geometry of the plurality of teeth 204. More particularly, the teeth 204 comprise a first gripping surface 214 having four closely spaced rows of teeth adjacent the leading edge 208 and a second gripping surface 215 having more widely spaced rows of teeth. Additionally, the height of teeth 214 is smaller than the height of teeth 215. The teeth geometry described above provides an initial gripping surface 214 adapted for penetrating a small crevice of a high strength material. As the size of the crevice is widened with the spreader 10, the blade tip 200 wedges itself deeper into the widened crevice and the gripping surface 215 further pulls apart the high strength material.

Figure 3D:
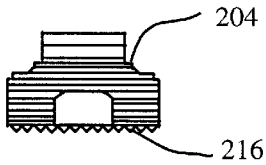
FIG. 3*d* is a front view of the forked blade tip of FIG. 3*a*.

FIG. 3*d* is a front view of the forked blade tip of FIG. 3*a*. FIG. 3*d* shows the transverse ridge or teeth 216 orthogonal to said longitudinal teeth 204 of front face 202. The transverse ridges provide the function of gripping a high strength material when the arms of the blade tips are brought together. By way of example and not of limitation, the transverse ridges may be used to grip the floorboards of a vehicle with the hydraulic spreader arms engaged to move towards one another. A ram may then be used to push against the blade tips thereby permitting extraction of an injured individual.

Figure 3E:
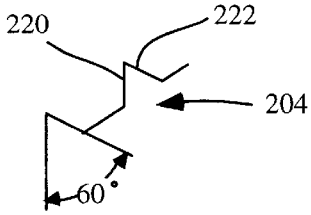
FIG. 3*e* shows the longitudinal teeth of the forked blade tip of FIG. 3*a*.

FIG. 3*e* shows the geometry of longitudinal teeth 204 of the forked blade tip of FIG. 3*a*. Each longitudinal tooth 204 has a triangular geometry which comprises a pair of longitudinal faces 220 and 222 which are at an angle 60° from one another. The triangular longitudinal teeth geometry provides a gripping surface capable of initially penetrating a crevice. Once the crevice has been penetrated, the gripping surfaces 214 and 215 provide a surface which holds the high tensile strength material as it is spread apart.

Figure 3F:
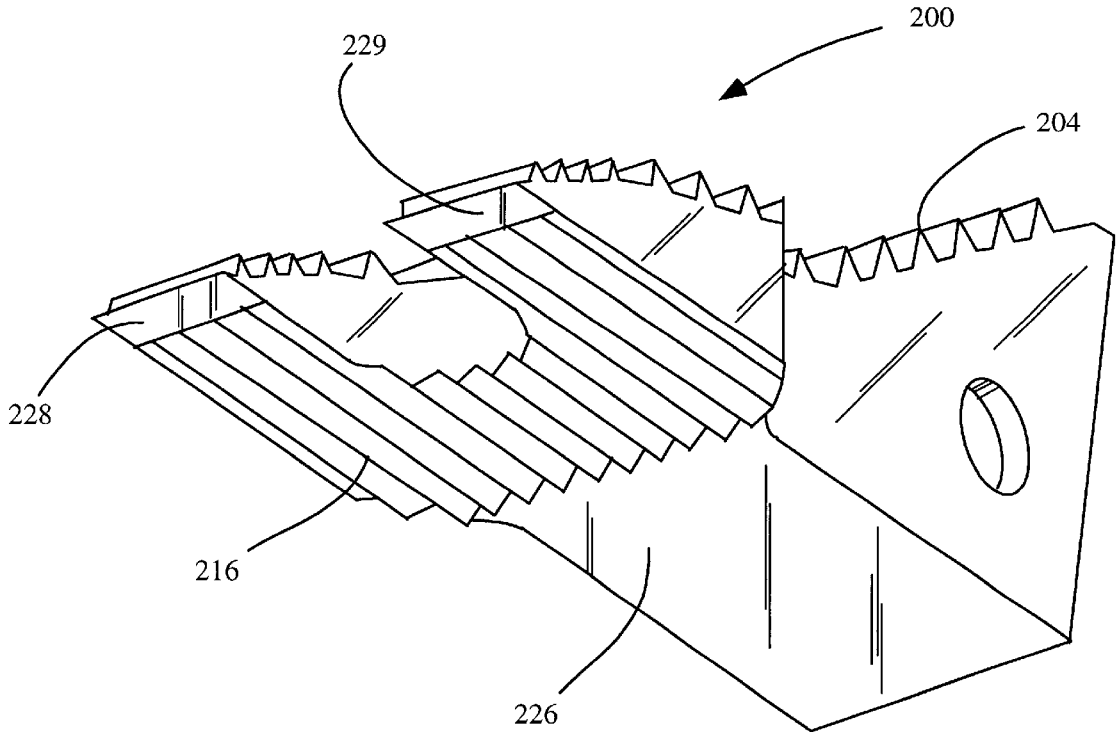
FIG. 3*f* is an isometric view of the transverse ridges of the forked blade tip.

FIG. 3*f* is an isometric view of the transverse ridges 16. Transverse ridges 216 are disposed primarily on the footprint 210 portion of the second face 224. A flat pair of lips 228 and 229 on the second face 224 is adjacent leading edge 208 and does not have transverse ridges. The flat lips 228 and 229 and the leading edge provide a wedge for insertion into the crevice.

Figure 4A:
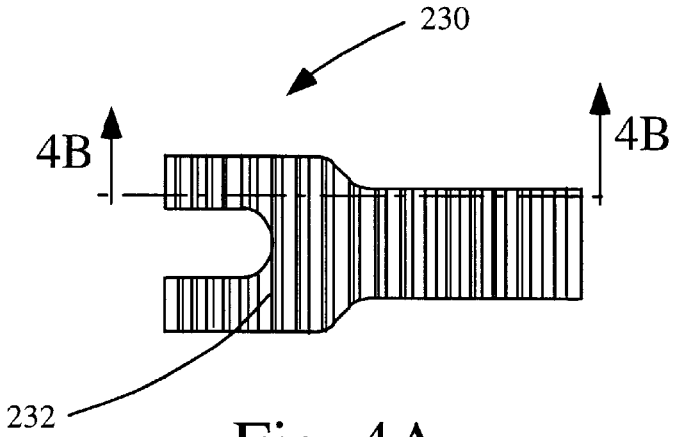
FIG. 4*a* is a top view of another alternative forked blade tip.

FIG. 4*a* is a top view of a forked blade tip 230 adapted to be received by a Amkus spreader. As previously described, FIG. 4*a* shows the wide footprint 232 which defines a cavity. Additionally, the geometric shape of the teeth and frequency of the teeth are similar to description of the teeth provided in FIG. 3.

Figure 4B:
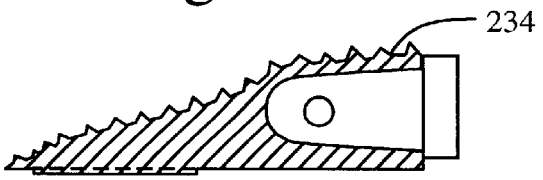
FIG. 4*b* is a cross-sectional view of the forked blade tip of FIG. 4*a* at section 4*b*.

FIG. 4*b* is a cross-sectional view of FIG. 4*a* at section 4*b*. FIG. 4*b* shows a receiving end 234 adapted to receive the Amkus spreader. The transverse ridges of forked blade tip 230 on a second face have been described above.

Figure 5A:
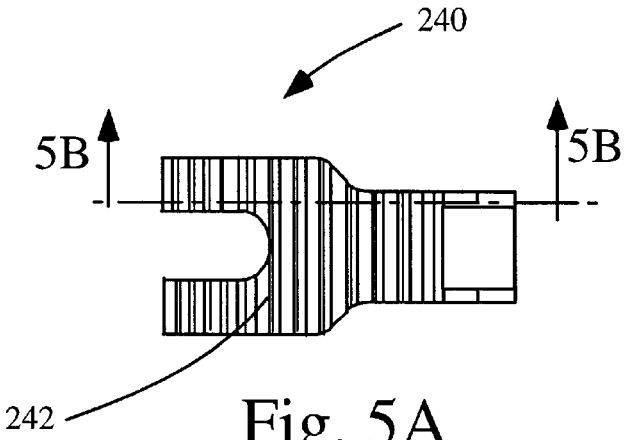
FIG. 5*a* is a top view of another alternative forked blade tip.

FIG. 5*a* is a top view of a forked blade tip 240 for a Holmatro spreader. The wide footprint 242 is adapted to engage and spread the high strength materials. A similar tooth design as described above in FIG. 3*a* through 3*f* is used.

Figure 5B:
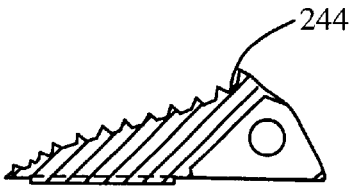
FIG. 5*b* is a cross-sectional view of the forked blade tip at of FIG. 5*a* at section 5*b*.

FIG. 5*b* is a cross-sectional view of FIG. 5*a* at section 5*b*. FIG. 5*b* shows the modified design for receiving end 244 which is adapted to receive the Holmatro spreader. The transverse ridges of forked blade tip 240 on a second face are described above.

Figure 6A:
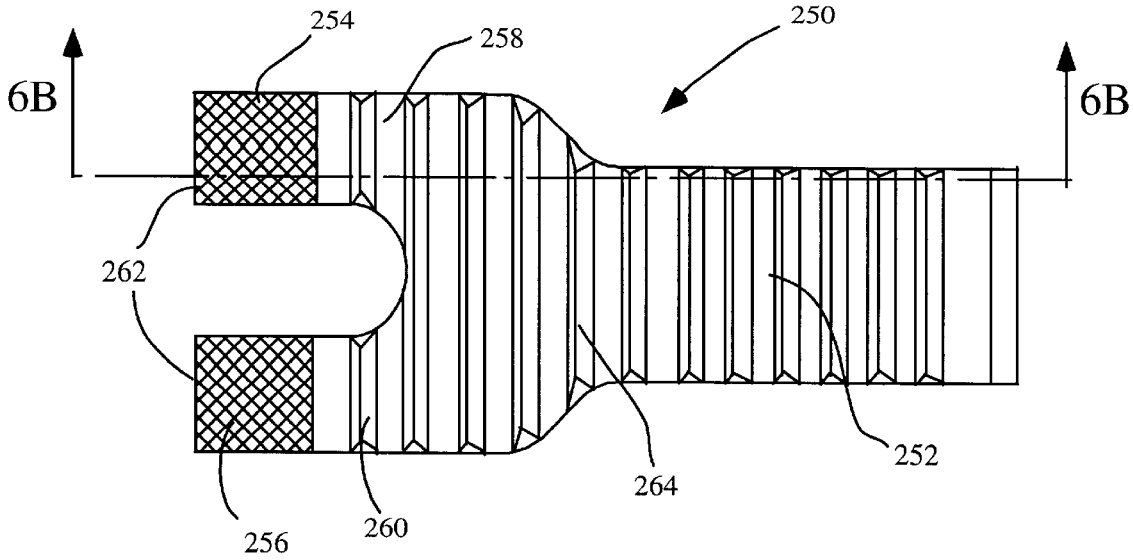
FIG. 6*a* is a top view of an alternative forked blade tip having a diamond knurled surface.

FIG. 6*a* is a top view of a forked blade tip 250 having a diamond knurled region. The blade tip 250 has a front face 252 with a knurled surface in regions 254 and 256 which are disposed on first fork 258 and second fork 260, respectively. The knurled surfaces 254 and 256 are adjacent leading edge 258. Next to the knurled surface regions 254 and 256 is a toothed gripping surface 264 having longitudinal teeth. The knurled surfaces 254 and 256 permit the blade tip 250 to provide an initial gripping surface for inserting into a small crevice. During use by the spreader, the blade tip 250 wedges itself deeper into the widened crevice and the toothed gripping surface 264 further pulls apart the high strength material.

Figure 6B:
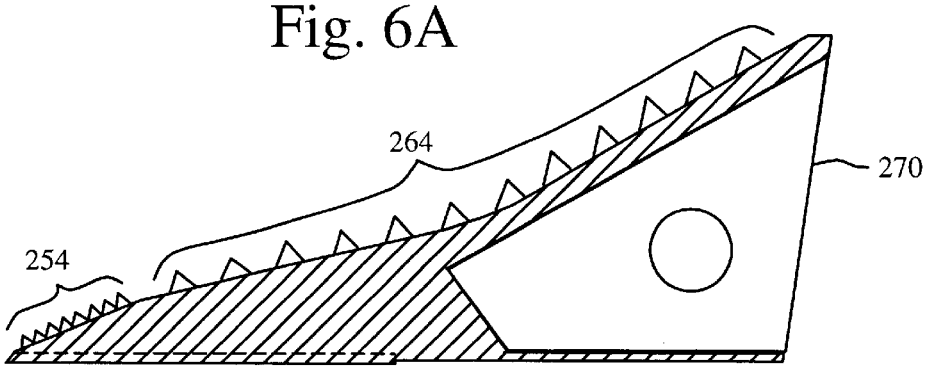
FIG. 6*b* is a cross-sectional view of the forked blade tip of FIG. 6*a* at section 6*b*.

FIG. 6*b* is a cross-sectional view of section 6*b*. FIG. 6*b* shows the receiving end 270 adapted to receive the arm of a Hurst spreader. Additionally, FIG. 6*b* shows the cross-sectional view of knurled surface 254 and of a gripping surface 264.

Figure 6C:
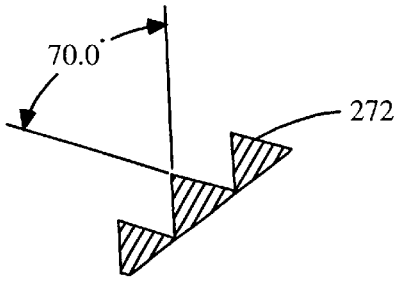
FIG. 6*c* is an exploded side view of the diamond knurled portion of the forked blade tip of FIG. 6*a*.

FIG. 6*c* is an exploded side view of the diamond knurled surface 272 of FIG. 6*a*. The knurled surface 272 is shaped as a plurality of polygons or pyramids, in which each pyramid has a square base with four triangles in which the bases of each triangle define the sides of the square base. By way of example and not of limitation, the triangle of the knurled surface design is an isosceles triangle having a 70° angle as shown in FIG. 6*c*. The knurled surface 272 provides a gripping surface for initially penetrating a crevice.

Figure 6D:
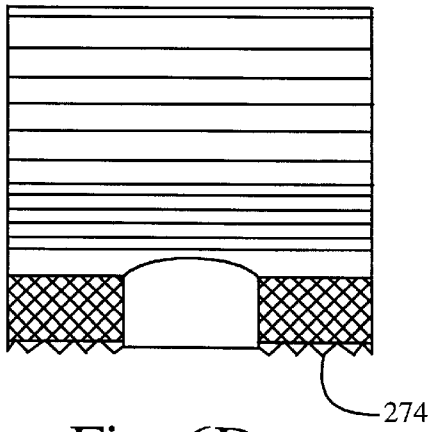
FIG. 6*d* is a front view of the forked blade tip of FIG. 6*a*.

FIG. 6*d* is a front view of FIG. 6*a* which shows the transverse ridges 274 orthogonal to the longitudinal teeth of gripping surface 264 of front face 202. The transverse ridges provide the function of gripping a high strength surface when the spreader is engaged inwardly as described above.

Although the description above contains many specificities, they should not be construed as limiting the scope of the invention, but as merely providing an illustration of the presently preferred embodiment of the invention. The scope of the invention should be determined by the appended claims and their legal equivalents.

What is claimed is:

1. A blade tip for spreading apart high strength materials, comprising:

a front face disposed on said blade tip having a first gripping surface and a second gripping surface configured to grip said high strength materials, said front face including a leading edge configured to be inserted into a crevice of said high strength materials, said first griping surface and said second gripping surface having a plurality of longitudinal teeth configured to grip said high strength material, and said second gripping surface having greater height than said first gripping surface;

a first prong and a second prong defining a cavity which is configured to receive an anchor point; and a second face sharing said leading edge with said front face, said second face having a plurality of transverse teeth orthogonal to said longitudinal teeth of said front face.

2. A blade tip comprising:

a leading edge disposed on said blade tip and configured to be inserted into a crevice of a high strength material;

a wide footprint proximate to said leading edge and a narrow footprint proximate to a receiving end, said receiving end configured to receive a spreader;

a second face having a plurality of transverse teeth;

a gripping surface sharing said leading edge with said second face, said gripping surface configured to grip said high strength material;

a plurality of longitudinal teeth disposed on said gripping surface orthogonal to said plurality of transverse teeth of said second face.

* * * * *